United States Patent [19]

Hsueh et al.

[11] 4,116,488

[45] Sep. 26, 1978

[54] IN-SITU MINING METHOD AND APPARATUS

[75] Inventors: Limin Hsueh, Bedford; Robert A. Hard, Still River; Donald H. Davidson, Bedford; Ray V. Huff, Acton, all of Mass.

[73] Assignee: Kennecott Copper Corporation, New York, N.Y.

[21] Appl. No.: 724,548

[22] Filed: Sep. 20, 1976

[51] Int. Cl.[2] ..... E21C 43/28

[52] U.S. Cl. ..... 299/4; 261/122

[58] Field of Search ..... 299/4, 5; 261/77, 122, 261/94, 100, 103, 104, 107, DIG. 75; 423/18

[56] References Cited

U.S. PATENT DOCUMENTS

| | | | |
|---|---|---|---|
| 3,307,567 | 3/1967 | Gogarty et al. | 137/13 |
| 3,545,731 | 12/1970 | McManus | 261/122 |
| 3,708,206 | 1/1973 | Hard et al. | 299/5 |
| 3,958,945 | 5/1976 | Takahashi | 261/122 |

FOREIGN PATENT DOCUMENTS

| | | | |
|---|---|---|---|
| 694,918 | 7/1953 | United Kingdom | 261/DIG. 75 |

*Primary Examiner*—Ernest R. Purser
*Attorney, Agent, or Firm*—John L. Sniado; Anthony M. Lorusso

[57] ABSTRACT

An environmentally compatible, industrially safe, and potentially economic means for recovering copper and/or nickel from deep-seated deposits without resorting to extensive underground development. A two-phase ammoniacal leach solution containing oxygen bubbles is forced under high pressure through an injection hole several thousand feet deep into a leaching interval of a deep lying deposit containing copper or nickel or copper and nickel. The two-phase leach solution travels through the leaching interval of the deep lying deposit and is pumped out of withdrawal holes spaced apart from the injection hole.

The two-phase leach solution under high pressure (more than 500 psi) penetrates the deposit through cracks, fissures and fractures, leaching copper and/or nickel along the way. Under a controlled pressure gradient, the leaching solution migrates over a period of time to receiving holes from which the pregnant leaching solution is withdrawn. The pregnant solution is then processed for recovery of copper or nickel or copper and nickel before it is returned to an injection hole.

A method and apparatus for producing the two-phase leach solution and for maintaining a system in which the gas bubbles are able to penetrate the deposit is disclosed.

Also disclosed are various parameters, such as hole spacing techniques, hole completion techniques and stimulation techniques.

98 Claims, 8 Drawing Figures

IN-SITU MINING METHOD AND APPARATUS

BACKGROUND OF THE INVENTION

With the world's known sources of high grade copper and nickel diminishing rapidly, great emphasis has been placed on discovering new sources of these metals. There is known to be located throughout various regions on the globe, large, deep lying deposits of copper in the form of low grade porphyry ores. A porphyry copper ore deposit is a copper deposit in which the copper-bearing minerals occur in disseminated grains and/or in veinlets through a large volume of rock. The term was introduced because some of the first large copper deposits that were mined in the western United States occurred in porphyritic granodiorite and quartz monzonite. Today, the term implies a large low-grade disseminated copper deposit in various host rocks such as schist, silicated limestone, and volcanic rocks; but, acid igneous intrusive rocks are usually in close association.

The deposits are typically large tonnage but low grade, having an average copper concentration of less than about 1 percent. Copper minerals found in these deposits usually are sulfides and most commonly are chalcopyrite. When such a deposit is of sufficiently high grade, and either outcrops on the surface or is sufficiently close to the surface, then the ore is mined by open pit methods and the copper minerals are separated from the gangue constituents by techniques such as flotation.

Deeply buried or very low grade copper porphyry deposits cannot be easily exploited. Recovering the copper values from such deposits presents many challenges. For example, conventional open pit mining is not available for such recovery for a number of reasons. First of all, the cost would be prohibitive. Secondly, because open pit mining scars the landscape, restrictions have been placed on the recovery of ores by such techniques.

It has been proposed to extract the copper from deeply buried porphyry deposits by in-situ leaching techniques. In-situ leaching is a well-known technique which has long been practiced; its origin can be traced as far back as the 15th century. With in-situ mining, a hole is drilled and a leach liquor is pumped down the hole into the ore containing the metal to be recovered. After the liquor has leached the metal values, the pregnant leach liquor is extracted to enable metal values to be recovered.

There are also massive sulfide deposits treatable by the present invention which are deep seated and contain discrete blebs of nickel sulfide, or copper sulfide or copper-nickel sulfide in association with iron sulfide. A representative list of minerals which can be treated to recover copper or nickel or both by the present invention includes: native copper, chalcocite, digenite, covellite, pentlandite, heazlewoodite, vaesite and violarite.

There are many prior art procedures for in-situ mining. Most of these procedures, however, involve rubblizing the ore which is to be leached by explosive methods.

The present invention involves leaching the copper in-situ (without rubblizing it) with a lixiviant containing very small oxygen bubbles admixed with an ammoniated leach liquor. The oxygen bubbles are produced by a sparger or mixing device. To be effective, the oxygen bubbles should be smaller than the fractures in the ore.

A two-phase lixiviant containing small sparger-produced oxygen bubbles is an important aspect of the invention. However, the broad concept of utilizing an ammoniated lixiviant containing small bubbles of oxygen to leach copper from ore formations in-situ is disclosed in U.S. Pat. No. 3,708,206 to Hard et al. However, prior to the present invention, a two-phase introduction of oxygen was unattractive for a number of reasons. Problems such as phase separation of oxygen prevented a two-phase system from being used efficiently. In attempting to bring a suitable dispersion of oxygen into a bore when employing an aqueous solution, numerous adverse conditions apply. For example, elaborate methods and/or equipment was thought to be necessary to obtain a stable dispersion of oxygen as a gas in an aqueous fluid.

Indeed, so severe were the problems associated with two-phase in-situ mining procedures that research in this area was discouraged. The problems associated with two-phase in-situ mining are severe because the dispersion of oxygen must be sufficiently well distributed and the bubbles of oxygen must be sufficiently small so that these may enter the pores or fracture apertures in the rock before phase disengagement can occur. Still further, the quantity of oxygen should be evenly distributed throughout an entire ore column which is being worked by the in-situ method. Prior to the present invention, from the standpoint of complexity, economics and utilization of oxygen these considerations have made it almost intolerable to use oxygen as a gas dispersed in a liquid.

At this point it should be noted that the system disclosed in Hard et al. U.S. Pat. No. 3,708,206 involves recovering metals from porous rock such as sandstone located at depths close to the surface (300–500 ft.). The present process on the other hand is directed toward recovering metals from deep, hard rock formations of low porosity.

With a section of core material taken from a leaching interval of a typical deep lying porphyry copper ore, the copper is found primarily within the fractures. The fractures from which the copper is leached may be very small in size. Indeed, with the process of the present invention, copper can be recovered from fractures that are only 30 microns to 300 microns in width.

When the present invention is practiced, it is not necessary to disturb the deposit by blasting. Indeed, it is believed that the present invention is the only practical process presently known in which copper can be leached economically from deep lying deposits by in-situ mining techniques without rubblizing the ore. That copper can be leached from deep-lying porphyry ores without disturbing the ore is remarkable when the nature of the ore being leached is considered.

Another significant advantage of the process of the present invention is that the copper can be mined economically from deep lying porphyry deposits without any significant environmental impact. For example, with the present invention, there are no subsidence problems. Furthermore, the only alteration on the land surface is the presence of a few buildings and pumps which can be removed after the copper and/or nickel has been mined.

SUMMARY OF THE INVENTION

Economical recovery of copper from deep lying porphyry deposits in accordance with the present invention is accomplished by the use of a two-phase lixiviant. The two-phase lixiviant includes an aqueous leach solution which carries finely divided bubbles of oxygen gas. In order for the two-phase system to be effective, the gas must remain dispersed as finely divided bubbles in liquid and the bubble size must be small enough to penetrate into the extremely small fractures of the porphyry deposits. In one preferred embodiment of the invention in order to introduce the finely divided gas bubbles into the liquid, the liquid phase is supplied to a plurality of porous tubes formed of sintered powdered metal while the gas is supplied under pressure about the tubes to cause the gas to penetrate into the interior of the tubes in the form of fine bubbles which are then wiped from the interior of the tube by the lixiviant passing therethrough. This mixing may be affected by a sparger located at the surface of the injection hole. The two-phase lixiviant can also be produced by mixing oxygen and liquid and maintaining a high linear velocity in the tubing which carries the solution to the leaching interval.

The two-phase lixiviant thus produced is passed down an injection hole to the leaching interval of a deep lying ore body located beneath a cemented and packed off portion of the injection hole. The two-phase lixiviant is injected into this hole through a venturi-type exhauster.

The exhauster unit has an extended ejection nozzle (stinger) which is downwardly directed and terminated within the injection interval. The exhauster and stinger prevent coalescence of the oxygen bubbles by enabling continuous vertical circulation of the lixiviant between the outlet of the injecting nozzle, which is located in the lower portion of the leaching interval, and an aspirator passage inlet which is located in the upper portion of the leaching interval.

The cooperative interaction between the sparger and exhauster yields an oxygenated lixiviant or leach liquor containing well dispersed minute oxygen bubbles. This unique two-phase lixiviant is able to effectively penetrate the fractures of the ore body and effect dissolution of the copper due to the minute bubble characteristics of the oxygen phase of the leach solution. The dissolved copper is removed through output holes and is recovered from the pregnant liquor by conventional technology.

Accordingly, an object of the present invention is to provide a new and improved method and apparatus for economically recovering metals such as copper or nickel from deep lying ores without resorting to open pit mining or extensive underground development.

Another object of the present invention is to provide a new improved method for in-situ mining of deep lying deposits of metal bearing ore that does not involve rubblizing the ore.

A further object of the present invention is to provide a process for recovering metals from deep lying deposits in a manner that is environmentally acceptable.

Another object of the present invention is to provide a method and apparatus for admixing very small oxygen bubbles into an ammoniated or acidic leach liquor to produce a two-phase lixiviant which is capable of penetrating the fractures of a deep lying ore deposit to oxidize the ore and thereby enable the metals in the ore to be leached in-situ.

Another object of the invention is to provide a process for recovering copper from deep lying porphyry ores by admixing very small oxygen bubbles into an ammoniated or acidic leach liquor to produce a two-phase lixiviant which is capable of penetrating the ore to leach copper in-situ.

DESCRIPTION OF THE PREFERRED EMBODIMENTS

Figure 1:
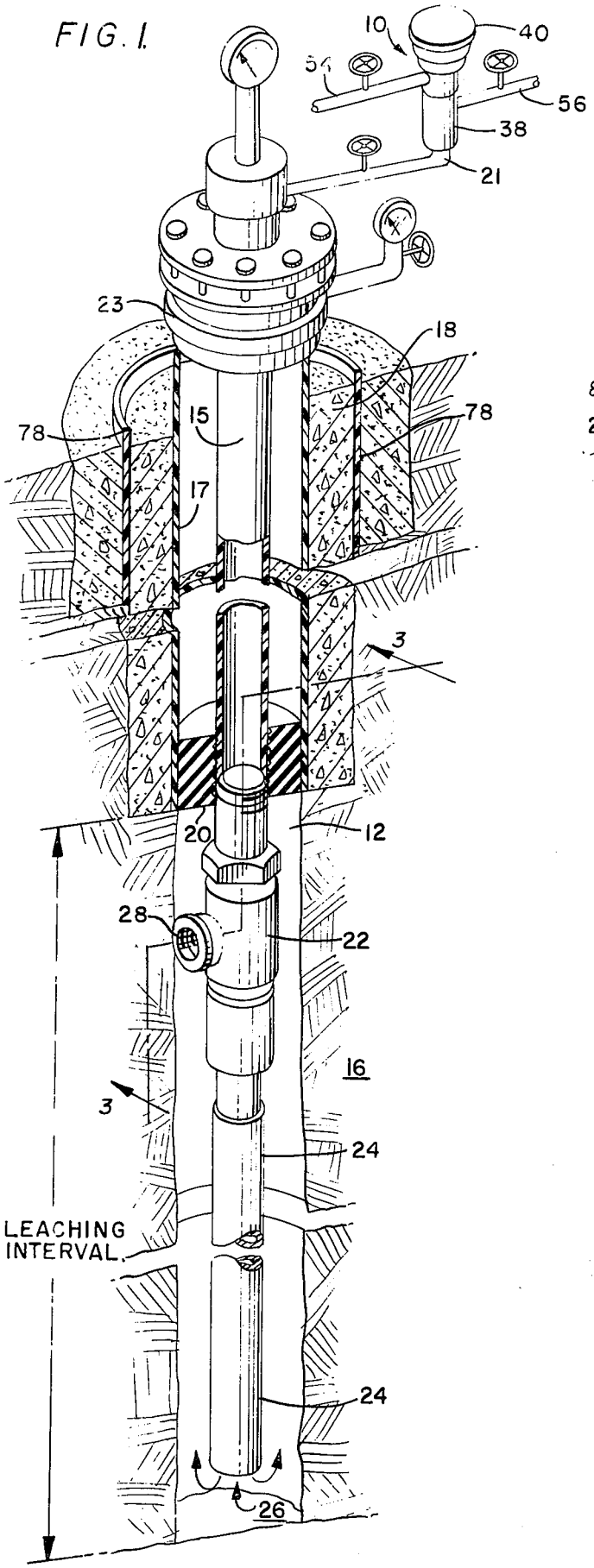
FIG. 1 is a perspective view of an assembly used in accordance with the present invention for admixing small oxygen bubbles into a liquid for injection into the leaching interval of an injection hole.

At the outset, the process and apparatus of the present invention is described in its broadest overall aspects with a more detailed description following.

In accordance with one important embodiment of the present invention, an ammoniacal lixiviant containing oxygen bubbles is employed to mine copper in-situ from ores lying thousands of feet below the ground.

In practicing the invention, very small oxygen bubbles are admixed with an ammoniated leach liquor to obtain a "two-phase" lixiviant. This mixing may be effected by a sparger 10 located at the surface of an injection hole 12. The sparger includes a sintered metal tube 14 arrangement (See FIG. 4) for injecting oxygen bubbles into the ammoniated leach liquor. The oxygen bubbles are minute and smaller than the fractures, and/or interstices of the ore body 16.

The two-phase lixiviant thus produced is passed down the tubing 15 of an injection hole 12 to the leaching interval of a deep lying ore body 16 located beneath a cased 17, cemented 18 and packed-off portion 20 of the injection hole 12. The two-phase lixiviant is injected into this zone through a venturi-type exhauster 22. This exhauster unit has an extended ejecting nozzle 24 (stinger) which is downwardly directed and terminated near the bottom of the injection interval. The purpose of the exhauster 22 and the stinger 24 is to prevent coalescence of the oxygen bubbles before they enter the ore by enabling continuous vertical circulation of the lixiviant between the outlet 26 of the ejecting nozzle, which is located in a lower portion of the leaching interval, and an aspirator passage inlet 28, which is located in an upper portion of the leaching interval.

The cooperative interaction between the sparger 10 and exhauster 22 yields an oxygenated lixiviant or leach liquor containing well dispersed, minute oxygen bubbles. This unique two-phase lixiviant is able to effectively penetrate the fractures of the ore body and effect dissolution of the copper due to the minute bubble characteristics of the oxygen phase of the leach solution.

Figure 4:
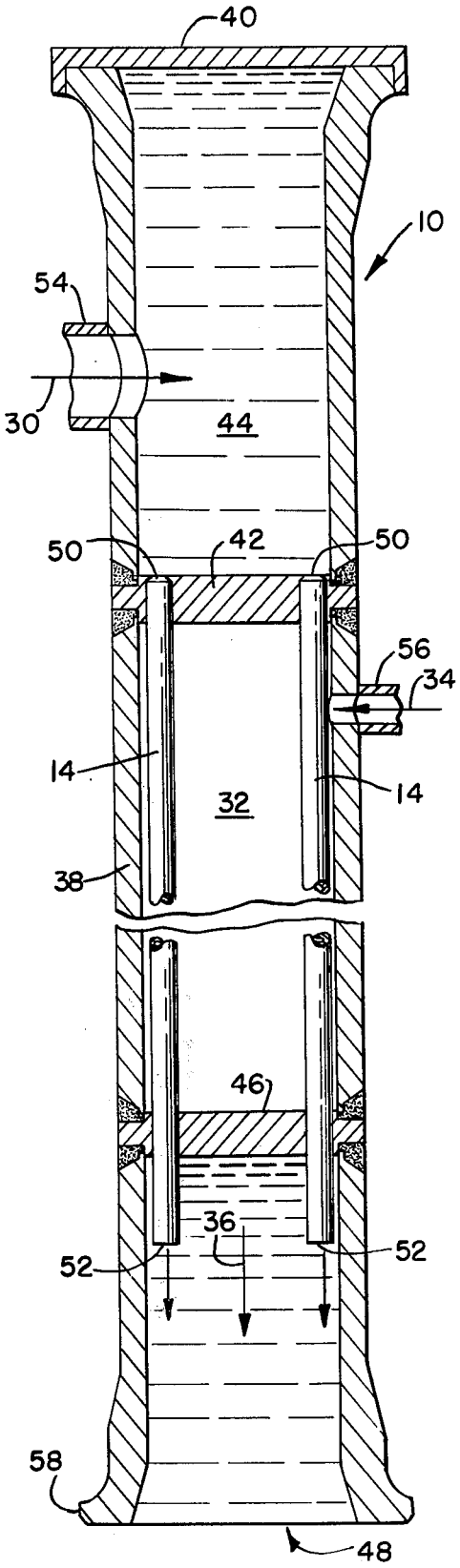
FIG. 4 is a cross-sectional view of the sparger of FIG. 1.

As is shown in FIGS. 1 and 4, the apparatus for use in in-situ mining in accordance with one embodiment of the present invention includes a sparger 10. In its overall aspect, the sparger 10 includes a plurality of sintered metal tubes 14 which serve to convey ammoniated lixiviant 30 through a pressurized oxygen containing chamber 32. Pressurized oxygen 34 passes through the porous walls of the sintered tubes and enters the ammoniated lixiviant flow as is shown by arrows 36. The two-phase flow thus produced passes from the sparger down into the hole to an injection zone or leaching interval beneath a packer 20. The porosity of the sintered metal tubes is such as to provide an oxygen bubble size which is of the same order of magnitude as the fracture openings in the ore formation 16. A sparger which can be used in accordance with the present invention is disclosed in U.S. Pat. application Ser. No. 724,549 entitled "In-Situ Mining Method and Apparatus for Sparging Gas Bubbles" by Hsueh et al filed on even date herewith and commonly assigned, the teachings of which are incorporated herein by reference.

Referring to FIG. 4, a gas sparging unit 10, constructed in accordance with the present invention, is illustrated in detail and consists of a generally cylindrical casing 38 formed from a plurality of annular members which are secured together to form an elongated cylindrical sleeve. The sleeve is closed at one end in any convenient manner, as for example by a flanged cap 40 or the like, and has a first partition plate 42 welded therein in order to define a first chamber 44 within the sleeve. The partition plate 42 is a generally circular member. A second similar partition member 46 is located adjacent the opposite end 48 of the sleeve (which defines an outlet end for the sparging unit) so as to define a second chamber 32 within the sparging unit.

A plurality of hollow elongated tubes 14 are mounted in the partitions 42 and 46 with one end 50 of each of the tubes being located in communication with the interior of chamber 44. The other ends 52 of the tubes 14 extend through the partition 46, adjacent the outlet opening 48 of the sleeve. These tubes are preferably formed of a sintered metal powder porous material having micro pores of a diameter of, for example, 50 microns, to permit small gas bubbles to be diffused therethrough. A general useful range of pore diameter is from 2 microns to 1,000 microns. A preferred range is from 10 to 100 microns. Such tubes may be formed of stainless steel powder or similar porous corrosion resistant material.

The porous sintered tubes are commercially available from Newmet, Inc., Pequabuck, Connecticut. The size of the pores in a tube is controlled by selecting proper particle size distribution of stainless steel powder and by sintering at a temperature slightly below the melting point of the stainless steel powder.

The number of such tubes used in a particular gas sparger unit can be varied as desired in accordance with the amount of gas bubbles required to be introduced into the lixiviant solution and the type of ore formation being treated as described hereinafter.

The first chamber 44 of the gas sparging unit 10 includes an inlet opening 54 through which an ammoniated lixiviant under pressure, is supplied from a source as is shown by arrow 30. Any convenient pumping apparatus can be utilized to supply the lixiviant from the source to the first chamber 44 of the gas sparging unit.

The second chamber 32 formed in the sleeve 38, includes an inlet opening 56. The gas to be introduced into the lixiviant solution is supplied through the inlet 56 under pressure from a source as is shown by arrow 34, in any convenient manner.

In accordance with the present invention, the gas supplied will be an oxidizing gas such as air, oxygen, oxygen enriched air, or a combination of oxygen and some catalyst, such as for example, $SO_2$, $SO_3$ or $NO_2$ as an acid forming gas. By supplying gas under pressure in this manner to the chamber 32, the gas is forced to penetrate through the porous tubes 14 in order to form small bubbles on the interior surfaces of the tubes. Since the upper ends 50 of the tubes are in communication with the chamber 44, the liquid lixiviant supplied to that chamber will flow through the tubes into contact with the small bubbles formed therein. The movement of the lixiviant through the tubes towards the discharge ends 52 thereof will wipe the bubbles from the interior surfaces of the tube and cause the bubbles to be intermixed within the lixiviant.

It has been found that the greater the velocity at which the barren lixiviant moves through the tubes, the smaller the bubbles introduced into the lixiviant will be. Generally, the proper velocity of lixiviant in a tube can be calculated from the amount and pressure of introduced lixiviant. Fluid velocity ranges from 2 ft./sec. to 50 ft./sec. have been found satisfactory when porous tubes of ¼ inch inside diameter are used. The size of the bubbles can also be varied or controlled by using porous tubes of varying diameters at a fixed flow. In this connection tubes having inside diameters of between about ⅛ inch and ½ inch have been found satisfactory when the tubes have pores with diameters ranging between 10 to 100 microns and with lixiviant velocities between 2 ft/sec. to 50 ft/sec.

The lixiviant solution thus mixed with the fine gas bubbles passes through the discharge openings 52 of the tubes to the discharge end 48 of the gas sparger unit.

In the embodiment of the invention shown in FIGS. 1 and 4, the gas sparging unit is adapted to be used above the ground. Accordingly, the end 58 may be connected in any convenient manner, as for example by an elbow joint 21, to the well head 23 and tubing string 15 which extends down the bore hole. In this embodiment, lixiviant mixed with gas bubbles passes down the tubing string 15 to the ore formation 16 to treat the metal values in the ore formation and create a pregnant liquor.

At this point, it should be noted that the preferred embodiments of the invention involves a sparger unit which is located on the surface of the ground. The invention, however, is not intended to be limited to this mode of operation. In fact, in some situations it may be desirable to place the sparger unit down the bore hole. Indeed, the patent application Ser. No. 742,549 referred to above entitled In-Situ Mining Method and Apparatus for Sparging Gas Bubbles, discloses a sparger unit which can be placed within the bore hole.

It should also be noted that the process of the present invention is not intended to be limited to the production of oxygen bubbles in a leach liquor by forcing the oxygen gas through the porous tubes in the manner discussed above. There are many methods for producing a two-phase lixiviant. In this regard, any mixer that is capable of mixing oxygen bubbles into a leach liquor and produce a two-phase lixiviant from which the oxygen bubbles can be forced into the fractures of the ore can be used in the present invention. Merely by way of example, the sparger or mixer can be a simple pipe with a T junction in which oxygen gas is supplied on one side of the T and the leach liquor is supplied to the other side of the T. The gas and liquid are mixed at the junction.

In any embodiment of the invention, the velocity and diameter of the tubing string are important. It will be apparent to those skilled in this art that if oxygen and liquid are passed down a narrow tube at high velocity, a two-phase lixiviant will be produced. Thus, an important concept to consider in conjunction with any mixing device or sparger is that when the sparger is combined with a tubing string of a particular diameter, with a gas and liquid being subjected to a particular high velocity down the tube string, turbulence would result which would homogenize the gas and the liquid to produce a two-phase lixiviant.

Another factor which influences the two-phase lixiviant is the including in the leach liquor of a surfactant. In accordance with the invention set forth in U.S. Pat. No. 4,045,084 entitled Improvements in In-Situ Mining of Copper and Nickel, filed on even date herewith, the teachings of which are incorporated herein by reference, it has been discovered that many surfactants, when added to the liquid phase prior to the introduction of the gas which form the bubbles greatly enhances the stability of bubbles formed. The use of a surfactant enables smaller bubbles to be formed and tends to maintain the size of the smaller bubbles for a substantial time during the mining procedure. In addition to the surfactant, the lixiviant may include an agent (Calnox ®) to stabilize calcium sulfate which results from a combination of calcium ions from certain orebody minerals and sulfate from chalcopyrite oxidation. A surfactant sold under the tradename Dowfax 2A1 by the Dow Chemical Co. has been found satisfactory. Dowfax 2A1 is the sodium salt of dodecylated oxydibenzene disulphonate having the formula:

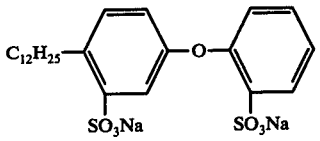

Immediately below the tubing string 15 is the exhauster (or eductor) 22. In one preferred embodiment of the invention the exhauster 22 is an aspirator or suction device that operates on well-known principles. Such exhausters (aspirators) are commercially available. Indeed, the exhauster 22 shown in the drawing is a Penberthy Series 180A exhauster which is manufactured by Penberthy-Division of Houdaille Industries, Inc., Prophetstown, Illinois 61277. This exhauster is available through plumbing contractors.

Figure 3:
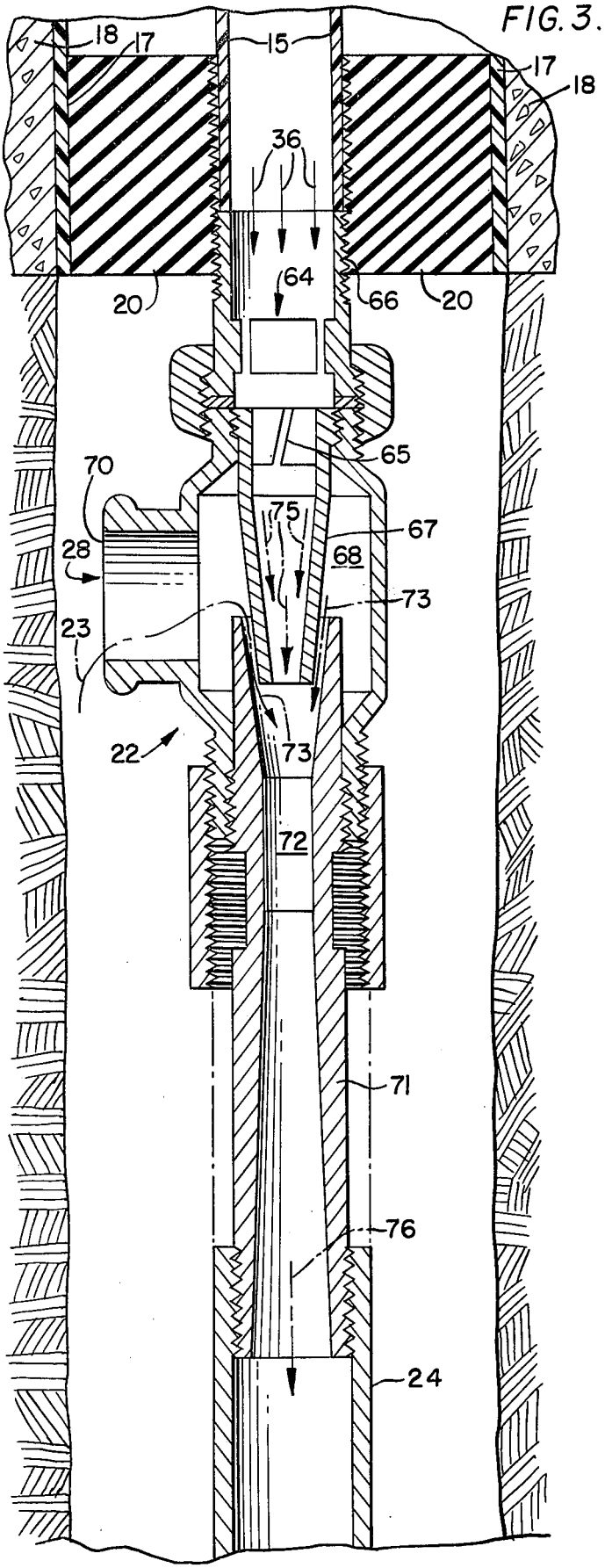
FIG. 3 is a cross-sectional view taken along line 3—3 of FIG. 1.

During the mining operation in accordance with the present invention, the two-phase lixiviant represented by arrow 36 (see FIG. 3) enters inlet 64 through nozzle 66 and travels past a whirler 65 into a nozzle 67 in suction chamber 68. Nozzle 67 converts the pressure head of this motive fluid into a high velocity stream which passes from the discharge side of the inlet nozzle.

Pumping action or suction begins when the vapor, liquid or gas in the suction chamber 68 is entrained by the jet stream emerging from the nozzle 67. This jet stream lowers the pressure in the suction chamber 68. The resulting action causes the fluid in the suction system to flow to the delivery jet 71 as is shown by arrow 73. The foregoing action creates suction through suction nozzle 70. The entrained material 73 from the suction system mixes with the motive fluid represented by arrow 75 and acquires a part of its energy in a diffuser 72. The velocity of the mixture leaving delivery jet 71 represented by arrow 76 is reconverted to a pressure greater than the suction pressure but lower than the motive pressure.

At this point it should be noted that a Penberthy steam, liquid, or air-operated jet pump, used for pumping, handling slurries or granular solids is called an ejector. However, it performs the same function as an aspirator. When a liquid-operated jet pump is used for pumping gases or vapor it is often called an exhauster. Regardless of the name, the principles of operation remain the same. Such pumps have many inherent advantages: they have no moving parts; therefore, there is nothing to break or wear; and, no lubrication is required.

The Penberthy series 183A exhauster is made of 316 stainless steel and has a nozzle size of 0.157 inch. To minimize the possibility of plug up, a course filter (not shown) is installed before the exhauster.

For a Penberthy series 183A exhauster with an injection rate (motive fluid) of 5 GPM, the suction fluid (entrained fluid) rate is 8.5 GPM and total discharge from the stinger 24 is 13.5 GPM. The pressure drop across the exhauster is 60 psi, the friction loss in stinger 24 is estimated to be 0.06 psi/ft which necessitates an additional 60–65 psi pressure increase at the surface sparger 10.

It is most advantageous to place the exhauster at the upper most point in the leaching interval where the gas may accumulate. Thus, in a preferred embodiment of the invention it is placed 8 inches or less below the packer 20. With this placement, the pressure differential within suction chamber 68 will draw the gas phase into suction nozzle 70 and deplete the gas pocket.

At this point, it should be noted that the purpose of the exhauster 22 is to prevent the formation of gas pockets beneath the packer. There are many devices which can perform this function, indeed an electrical pump can be used. It should be apparent, however, that a device such as exhauster 22 is preferred. Without any device, a gas pocket would form due to the disengagement of the oxygen bubbles from the two-phase lixiviant.

Of course, the selection of a particular exhauster is controlled by the flow rate of the lixiviant. The Penberthy series 183A exhauster is applied to systems in which there is a maximum flow rate of 10 gallons per minute. When the flow rate is increased, a larger exhauster is necessary. The selection of a suitable exhauster for a commercial mining operation is well within the skill of those in this art.

Immediately below the exhauster is a tail pipe or stinger 24 which extends to a point near the bottom of the leaching interval.

A factor which affects the efficiency of the process is the extent of the dispersion of oxygen in the leach liquor. It has been found that a turbulent flow can be used to maintain a uniform dispersion of gas and liquor from the surface to the bottom of the injection interval. To obtain copper loadings in excess of ½ gpl using oxygen as a lixiviant, a two-phase mixture must be uniformly injected into the ground. When gas and liquid are mixed at the surface, a uniform dispersion must be maintained as the mixture is transported downhole to insure uniform injection of both phases into the rock or ore.

There are at least three parameters which can be controlled to effect a high dispersion of oxygen in the liquid. These include the velocity of the fluid, the diameter of the tubing string and stinger and the point at which the mixture is injected in the injection interval. It is preferred to utilize a tubing string and stinger having an inside diameter of 3 inches or less. With tubing strings of this diameter it is advantageous to maintain the flow rate of the two-phase lixiviant at a velocity of one foot per second or greater. It is also advantageous to inject the lixiviant at the bottom of the injection of leaching interval.

When the leaching interval extends to the bottom of the bore, the stinger is positioned so the end of the stinger is about two feet from the bottom of the bore. The two-foot spacing is used to provide for the possibility of particulates and debris depositing beneath the stinger. At this point, it should be noted in the commercial operation, the length of the leaching interval can be between 1,000 and 3,000 feet in length. Of course, leaching intervals in the order of 200 feet are also possible. The length of the leaching interval is controlled by the nature of the ore formation being mined. Factors to be considered are concentration, ore grade, depth, etc. The size of the eductor or exhauster is influenced by the pressure drop in the tail pipe or stinger which is influenced by the length and the diameter of the tail pipe.

Although the drilling of injection holes shown in FIG. 1 is conventional, a brief description of the procedures for constructing injection holes appears below.

Prior to drilling an injection hole, a drill pad must be constructed for the drilling site. The size of the pad will depend on the size and type of the rig to be employed and the number of holes to be drilled from the pad. Many rotary-drill rigs will require a pad 200 ft. square.

To bore a large diameter, (in excess of 5 inches) hole into the deposit to a depth of 5000–6000 feet requires a moderate size rotary drilling rig. These rigs are commonly used in the exploration and exploitation of oil reserves.

The casing is a tubular form of steel or fiber glass reinforced plastic that is screwed or welded together as it is lowered into the hole to a desired depth. The function of the casing is to control fluid movement. One or more strings of casing of different diameters may be required during the drilling or completion of the hole. The conductor casing string (not shown) is the largest diameter string used in the hole and is required to control erosion of the soil at the surface by the return flow of drilling fluid. So called surface casing 78 has the next largest diameter. Surface casing 78 is fitted inside the conductor casing and is used to isolate the near-surface formation to protect fresh water zones, if any, and prevent weathered rock from falling into the hole during subsequent operation. The smallest diameter string of casing, the long string 17 is set above or through the injection or production interval. This string of casing is placed within the surface casing. If the long string 17 is set above the leaching interval, the hole is said to have an open-hole completion. Such a completion is shown in FIG. 1. If the long string casing is set through the interval, the casing must be perforated to gain access to the formation. This results in a perforated casing completion. Perforated casing completion may be used in the present invention; but, open hole completion is preferred.

Each string of casing is cemented into the hole using known techniques. Cementing is necessary to bond the casing firmly to the rock to prevent fluid from moving up or down the annulus behind the casing and to provide support for any subsequent casing string to be run into the hole. The cement may also protect the casing from corrosive fluids.

After the hole has been drilled, casing landed and cemented, additional equipment is placed in the hole. It is preferred to install injection equipment as follows. A tail pipe 24 or stinger long enough to extend from the top to near the bottom of the injection interval is run first. Attached to the top of the tail pipe is the exhauster 22. The exhauster 22 is attached onto the bottom of a packer 20. The packer 20 is screwed onto the bottom of the tubing string 15 which is hung from the well head 23.

As shown in the drawing, the tubing string 15 is within the casing string 17 and the casing string 17 is surrounded by a cement wall 18. The packer 20 is between the tubing string 15 and the casing string 17. The purpose of the packer 20 is to prevent the lixiviant from rising in the annular space between the tubing string 15 and the casing string 17. The tubing string 15 itself is formed from sections of fiberglass or other tubing of a single diameter which are screwed together. In a commercial operation tubing string inside diameter may be between 2½ and 3½ inches. The wall thickness is approximately ½ inch.

The packer 20 is a standard instrument used in the oil industry which is composed of central mandrel with an expandable rubber element which can be expanded either hydraulically or mechanically. Once positioned, the packer 20 is expanded so that the sealing element engages the inside wall of the casing 17.

The seal effected by the packer prevents subsequently injected fluids from rising up the annulus between the tubing and the casing. This forces all injected fluids to flow into the injection interval.

It is preferred to withdraw the pregnant metal bearing liquor from production holes (see FIG. 2) that are separated from the injection holes. Production holes are drilled in the same manner as injection holes.

Figure 2:
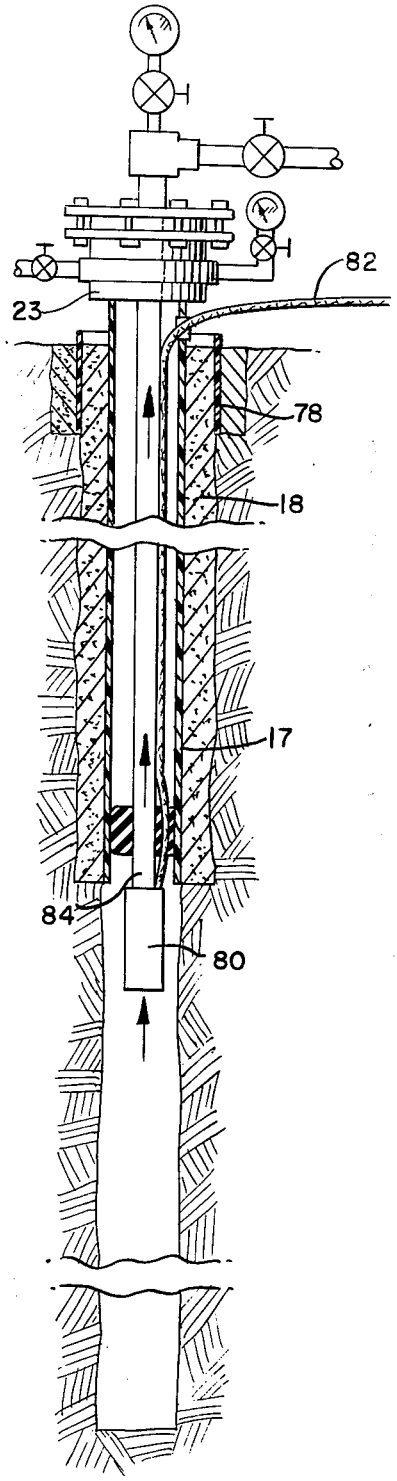
FIG. 2 is a view of a production hole for withdrawing pregnant leach liquor.

As is shown in FIG. 2, an electrical, submersible pump 80 is lowered into the hole by use of a reinforced power cable 82. Suitable well-head equipment 23 is installed to control the movement of produced fluid and provide a suitable seal where the power cable 82 exits. After the power cable is energized, the pump can be activated and fluid pumped to the surface.

Figure 5:
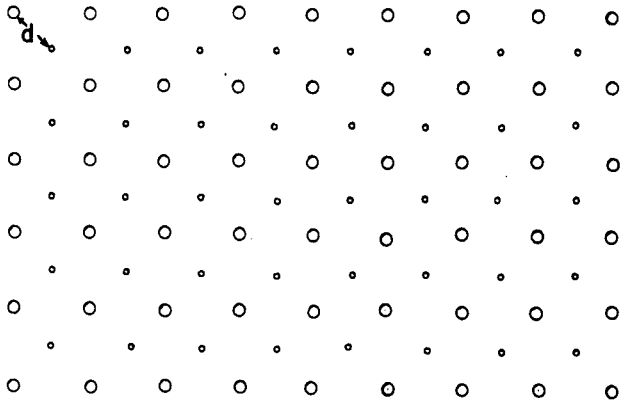
FIG. 5 is a diagram of a "five-spot" drilling pattern.

A preferred surface layout is a so-called 5-spot pattern which is shown in FIG. 5 of the drawing. In FIG. 5, a dot (.) indicates the location of an injection hole, a circle (o) indicates the location of a production hole, and (d) indicates the distance between injection and production holes. For environmental reasons there are no injection holes on the perimeter of the layout. Further details on the significance of the 5-spot pattern appear below.

In accordance with one important embodiment of the present invention, copper is leached from a sulfide deposit such as chalcopyrite with a two-phase lixiviant. The two-phase lixiviant includes ammonia and oxygen. During the leaching, the following reaction is believed to occur.

$$Cu^{+2}Fe^{+2}S_2 + 4.25\ O_2 + 1.5\ H_2O + 6NH_3 = Cu^{+2}(NH_3)_4SO_4 + Fe^{+3}OOH + (NH_4)_2SO_4$$

$$Fe^{+2}S_2 + 3.75\ O_2 + 2.5\ H_2O + 4NH_3 = Fe^{+3}OOH + 2(NH_4)_2SO_4$$

Of course, nickel, cobalt and molybdenum, if present as sulfides in the ore will also be leached in accordance with known chemistry. At this point, it should be noted that the primary purpose of the oxygen is to break the chemical bonds holding the copper in the chalcopyrite by oxidizing the sulfide and iron component. Once the chalcopyrite is oxidized, the aqueous ammonia is able to dissolve the copper values. It makes no difference whether or not the copper is oxidized. Indeed it is believed that the $CuFeS_2$ contains copper as cupric copper and iron as ferrous iron. Thus, during oxidation in accordance with the foregoing reaction, the oxidation state of copper remains unchanged while the iron is oxidized from $Fe^{+2}$ to $Fe^{+3}$. Of course, if $Cu^{+}$ copper is present in the ore, it would also be leached by the lixiviant. Since both forms of copper ions are leachable, it is not necessary to oxidize cuprous ions to cupric ions in order to leach copper.

A sufficient excess of aqueous ammonia is used to keep the pregnant solution alkaline. Under these conditions, dissolution of gangue materials is negligible and the pregnant solution contains virtually only ammonia, ammonium sulfate, and cupric ammine sulfate.

The foregoing system in which oxygen is admixed with an ammoniacal leach liquor is referred to as an oxygen-ammonia lixiviant. It is to be understood, however, that other two-phase lixiviants can be used in accordance with the present invention. The oxygen-ammonia lixiviant is preferred where there is a lot of acid-consuming minerals in the ore body. However, a representative example of another two-phase system that can be used to leach copper and nickel from a sulfate deposit includes the so-called oxygen-water lixiviant.

The chemistry for the oxygen-water lixiviant appears below.

$$CuFeS_2 + 4.25\ O_2 + 1.5\ H_2O \rightarrow CuSO_4 + FeOOH + H_2SO_4$$

$$FeS_2 + 3.75\ O_2 + 2.5\ H_2O \rightarrow FeOOH + 2H_2SO_4$$

When an oxygen-water lixiviant is used, cupric sulfate and sulfuric acid are generated in the leaching process or added on the surface. The cupric sulfate and sulfuric acid dissolve gangue metal oxides (Fe, Mg, Al, Ca, etc.) as sulfates. Much of the iron and aluminum precipitates in-situ as jarosite and alunite. In the surface plant, copper is extracted, and if necessary, the pH is adjusted to the desired level. The resulting leach solution is reinjected together with make-up oxygen. Another name for the oxygen-water lixiviant is the oxygen-acid lixiviant.

The process of the present invention is used to great advantage for deep-lying ore bodies, that is, ore bodies located at a depth of 1,000 feet or more below the surface. Although, the surface is normally a land surface, it should be noted that there is no reason why this process cannot be used to recover copper from deposits located below the bottom of the continental shelf or a lake bed. Thus, when reference is made to the depth of deposit below the surface, the surface can either be land surface or the surface of a body of water underneath which the deposit is located. The real significance of the fact that the process is used to treat deep-lying deposits is that in order for the process to be used practically, the lixiviant must be injected into the ore body under a head of pressure which is just below the fracturing pressure of the ore body. The process of the present invention takes advantage of the fact that the depth at which the ore body is located provides a lid for the pressurized lixiviant. It is preferred to locate the injection interval below the water table because it acts as the lid for this pressure head. In short, the process of the present invention could not be used to great advantage to leach ore bodies that are located close to the surface, that is 200 feet or less. The correct maximum down hole injection pressure of the lixiviant is limited by the fracture pressure at the top of the leaching interval.

The two-phase flow injection system for the commercial operation is divided into two modes of operation; downhole, and surface sparging. In the former case the surface pressures of gas and liquid must be controlled separately, because the pressure difference between the surface and the top of the leaching interval is related to the individual phase densities. In the surface sparging mode the surface pressures of gas and liquid are the same, and must exceed a minimum level to insure that a stable gas-liquid dispersion is transported downhole. In both cases, a second control point requires that the pressure at the top of the injection interval be less than the rock fracturing pressure.

In downhole sparging, the liquid surface pressure is equal to the pressure at the top of the injection interval, less the hydrostatic head from the surface to the top of the injection interval, plus friction drops through the sparger, eductor, and tubing string. At commercial flow rates, the friction drop in the tubing string for the liquid is less than 10% of the hydrostatic gradient for tubing diameters greater than 2.5 inches. The surface pressure for the liquid, $P_{SL}$, is approximated as:

$$p_{SL} = (A_f - 0.433)(D-H) + \Delta p_{fe} + \Delta p_{fs} \quad (1)$$

$A_f$ = fracture gradient, $0.7 \leqq A_f \leqq 1$, psi/ft
$\Delta p_{fE}$ = pressure drop across eductor, psi
$\Delta p_{fS}$ = pressure drop across sparger, psi
$D$ = distance from surface to bottom of leaching interval
$H$ = distance from bottom of leaching interval to bottom of packer
$D-H$ = distance from surface to bottom of packer Example $A_f = 0.7$ psi/ft
$D = 5000$ feet
$H = 2500$ feet
$\Delta p_{fe} = \Delta p_{fs} = 200$ psi
$p_{SL} = 0.267 \times 2500 + 400 = 1067.5$ psig (2)

If a downhole pressure measurement is available, and the surface pressure of the liquid should be adjusted so that the pressure at depth (D−H) does not exceed $A_f$ (D−H), in the example case 1750 psi.

The gas surface pressure, $P_{gs}$, is equal to the pressure drop at the top of the injection interval, less the hydrostatic variation, plus the friction drops through the eductor and sparger. Since the gas is compressible, the hydrostatic pressure variation must be corrected for pressure and temperature variations in the tubing string.

$$P_{gs} = [A_f(D-H) + p_{fe} + p_{fs}]\left[\frac{T_{gs}}{T_{gs} + B(D-H)}\right]^{0.625} \quad (3)$$

$T_{gs}$ = surface temperature of gas in degree of Rankine, ° R $B$ = geothermal gradient, ° R per foot — 0.0325

Example $A_f = 0.7$ psi/foot, $D = 5000$, $H = 2500$ ft, $T_{gs} = 535°$ R $$P_{gs} = [(.7)(2500) + 200 + 200]\left[\frac{535}{535 + 2500(.0325}\right]^{0.625} \quad (4)$$

$$P_{gs} = (2150)(0.915) = 1968 \text{ psi} \quad (5)$$

In surface sparging, the gas and liquid surface pressures are the same and must be controlled above a minimum level such that the gas volume fraction in the tubing string does not exceed a critical value between 20% and 25%. The minimum surface pressure, $P_{SM}$, is also related to the copper loading and efficiency of oxygen usage, assuming sulfate as the oxidation product.

$$P_{SM} \geqq (23.7)(1 - f_{gc}/f_{gc})(\text{Cu}/E), \text{ in psi} \quad (6)$$

Cu = copper loading, gpl $E$ = overall efficiency of oxygen utilization $f_{gc}$ = critical gas volume fraction associated with bubbly flow, $0.2 \leqq f_{gc} \leqq 0.25$ Example $$f_{gc} = 0.25, \text{Cu} = 6. \text{ gpl}, E = 0.40 \quad (7)$$

$$P_{SM} \geqq 1067 \text{ psi}$$

The constant 23.7 is good for chalcopyrite only. In the case of Pentlandite, $NiFe_2S_3$, a main nickel sulfide ore, the constant would be 39.2 and for the case of molybdenite, $MoS_2$, a major molybdenum ore, the constant would be 16.6

In general, for a sulfide ore body having the formula of $MFe_yS_x$ where the oxidized product are $M^{+z}$ and sulfate, the constant can be calculated from $$P_{SM} \geqq \left(\frac{354.7\,[1.5x + 0.75y + 0.25z]}{MW}\right)\left(\frac{1 - f_{gc}}{f_{gc}}\right) \quad (\text{M/E,})$$

where M is the metal loading in gpl of the ore metal values to be recovered, E is the overall efficiency of oxygen utilization, MW is the molecular weight of the metal ion to be recovered, $z$ is the valance of the metal ion to be recovered in solution, and $y$ and $x$ are the subscripts for Fe and S, respectively, in the sulfide mineral structure $MFe_yS_x$. For example during leaching -

$$MFe_yS_x + \ldots \rightarrow M^{+z} + SO_4^{=} + FeOOH + \ldots$$

so for;

CuFeS: $x = 1, y = 1, z = 2$ $NiFe_2S_3$: $x = 3, y = 2, z = 2$ $MoS_2$: $x = 2, y = 0, z = 6$

To insure that gas does not segregate and rise to the surface as it is being transported downhole the tubing size must be maintained below some maximum size, $d_{TM}$.

$$d_{TM} \leqq (0.69)(Q_L)^{.4} \text{ for water} \quad (8)$$

$d_{TM}$ = tubing diameter, inches $Q_L$ = flow rate of liquid in gallons per minutes For example at 190 gpm the maximum tubing size that can be used is 5.6 inches. Since the inside diameter of the cased portion of the hole above the injection interval is 6 inches, all tubing sizes that can be used are less than the critical diameter. When 25 ppm of the surfactant Dowfax is used in the lixiviant, $d_{TM}$ can be increased by a factor of 1.5.

The surface pressure can be controlled by: developing a friction drop in the tubing string, using a downhole choke or developing a large friction drop across the eductor. It is not necessary to have the diameter of stinger tubing 24 ($d_2$) the same as the diameter of tubing string 15 which runs from the surface to the eductor ($d_1$). The eductor operates at maximum efficiency when the friction drop in the stinger is a fraction of eductor suction, 40 psi. The minimum tubing diameter associated with a friction drop of 4 psi namely 1/10 oz. suction pressure is given by (9).

$$d_2 > (0.069)(H)^{.2}(Q_L)^{.4} \quad (9)$$

Example $H = 2500$ feet, $Q_L = 380$ gpm w/double recirculation $d_2 > 3.6$ inches Thus, if a 3.6 inch I.D. stinger 24 is used with a total circulation of 380 gpm in a 2500 foot interval less than a 4 psi friction drop will result, but stable flow will be insured as $d_2$ is less than the $d_{TM}$ of 5.6 inches computed from (8) with 190 gpm.

The surface pressure can be calculated once the following process parameters are fixed:

1. The liquid flow rate, $Q_L$ as gallons per minutes, gpm.
2. The gas flow rate $Q_G$, as standard cubic feet per minutes, SCFM.
3. The formation permeability, K as millidarcy, md.
4. The distance from the surface to the top of the injection interval, (D−H) as feet.
5. The injection interval, H as feet.
6. The tubing inside diameter, $d$ as inches.

The surface pressure is related to the above parameters in the following manner:

$$p_S = C_1 \frac{Q_L^a Q_g^b}{(K)^c (H)^d (D - H)^e d_1^f} \quad (10)$$

The constants and ranges of the independent variables are listed in Table I and II. If $p_S$ as calculated from (10) is less than the value of $p_{SM}$ as calculated from (6), either a downhole choke must be used to increase $p_S$ or the tubing string diameter $d_1$ decreased.

Table I

The Range of Parameters that Equation (10) is Applicable

| $Q_L$,gpm | $Q_g$,SCFM | K(md) | (D-H) ft. | H, feet | $d_1$, inches |
|---|---|---|---|---|---|
| 40–240 | 120–360 | 0.6–8.4 | 2500–5000 | 875–3205 | 1.6–4.0 |

Table II

Range of Constants

| $C_1$ | a | b | c | d | e | f |
|---|---|---|---|---|---|---|
| 31,031 | 0.206 | 0.673 | 0.661 | 0.657 | 0.316 | 0.623 |
| 25,5076 | 0.148 | 0.654 | 0.707 | 0.616 | 0.564 | 0.385 |

Prior to the present invention, the only deposits from which metal values were recovered by a two-phase lixiviant in-situ were sandstones or rubblized deposits. Indeed, the Hard et al patent discussed above is directed to recovering uranium from sandstone or rubblized deposits located about 200 feet below the surface of the land. The present invention, on the other hand, is directed to the recovery of metal values from rock or ore that has a permeability such that those skilled in this art would have been discouraged from attempting to recover metal values therefrom. For example, the permeability of a typical uranium containing sandstone is on the order of 100 to 1000 md. On the other hand the present invention is directed to recovering metal values from porphyry ores which have permeabilities of 50 md or lower. Thus, the present invention is applicable to treating hard rock located at depths of 1000 ft. or greater, which rock has a permeability of 50 md or less.

Another parameter which is conveniently dealt with by the present process is the leaching temperature. In order for the lixiviant to be able to extract metal values from the hard rock, the temperature of the lixiviant should be 40° C. or greater. If the lixiviant had to be heated to this temperature, that fact would increase processing cost. However, because the present invention is directed to recovering metal values from deep-lying deposits, the geothermal properties of the earth are used to heat the lixiviant to the required temperature. It is known that the thermal gradient is approximately 2 ½° F. per 100 feet in areas such as Safford, Arizona. Thus, at 1,000 feet below the surface, the temperature of the two-phase lixiviant would be 25° F. above the ambient temperature at the surface. Accordingly, an important aspect of the invention is to actually leach the metal values with a lixiviant that is maintained at a temperature of 40° C. In the present process this is accomplished without the necessity of any means for heating the lixiviant.

Figure 6A:
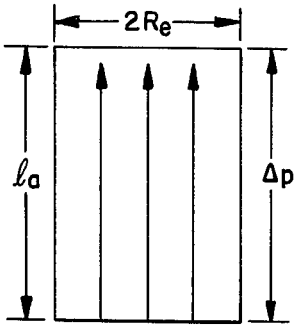
FIG. 6*a* is a diagram showing axial flow through horizontal fractures.
Figure 6B:
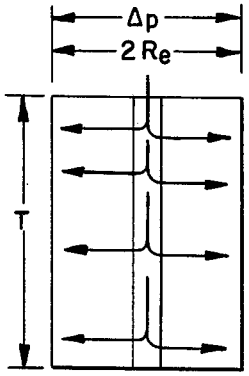
FIG. 6*b* is a diagram showing radial flow through vertical fractures.
Figure 6C:
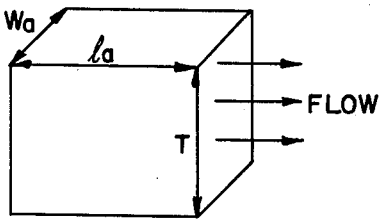
FIG. 6*c* is a diagram showing axial flow through vertical fractures.

The lixiviant can be forced through the ground in either linear or radial flow (see FIGS. 6A, 6B and 6C). Linear flow is obtained when the surface area normal to flow is constant between equipotential surfaces, that is, the pressure gradient is uniform between the injection and withdrawal points. In radial flow, the pressure gradient is inversely proportional to the distance from the point of injection.

Figure 7:
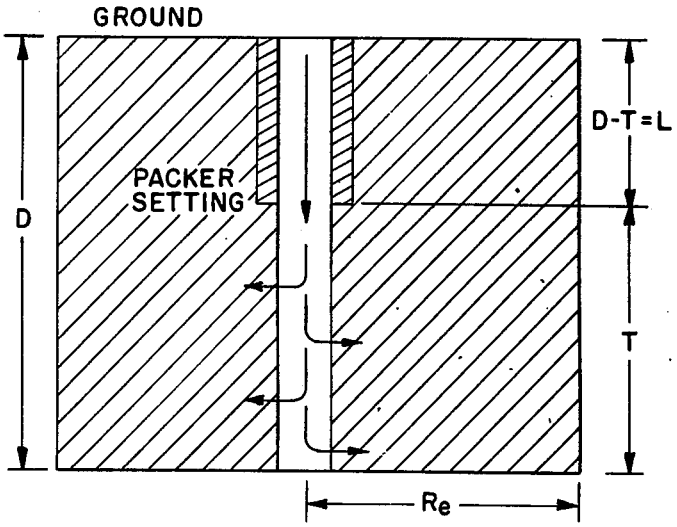
FIG. 7 is a diagram showing the flow pattern within the injection hole such as that shown in FIG. 1; and, FIG. 8 is a diagram illustrating a process for in-situ mining in accordance with the present invention.

The fluid flow analysis that follows is based on radial flow in a five-spot pattern (see FIG. 5). A vertical view of the hole is shown in FIG. 7. The hole is drilled to a total depth, D, and fluid is injected over some interval, T. In the production hole, a downhole pump, air-lift or swab is used to reduce the pressure at height, T, to the level at which the production and injection rates are comparable.

The flow rate for each hole in a five-spot pattern is calculated from equation (11) when the permeability, fluid viscosity, pressure drop, injection interval, and well spacing are specified. A consistent set of units must be used.

$$Q = \frac{\pi K T \Delta p}{\mu (\ln d/R_w - 0.619)} \tag{11}$$

If Q is expressed in gpm, K is in md, $\mu$ in centipoise, $\Delta p$ in psi, and T in feet, equation (11) becomes:

$$Q = 1.05 \times 10^{-4} \frac{kT \Delta p_T}{\mu} \frac{1}{\ln d/R_w - 0.619} \tag{12}$$

$\Delta p$ corresponds to the pressure drop between the injection and production holes, the maximum injection pressure is equal to the fracturing pressure. When the production hole is operated by drawing down the pressure at the top of the interval to atmospheric pressure, the maximum pressure drop is obtained.

For example, when:

$K = 3$ md
$\Delta p_T = 700$ psi
$\mu = 0.5$ centipoise
$d = 180$ feet
$R_w = 0.25$ feet
$T = 4000$ feet then Q = 312 gpm An injectivity test is used to measure the pressure drop that is required to inject fluid at a fixed rate into the deposit. Equation (13) is used to compute the deposit permeability.

$$K = (4760\, Q\, \mu\, \ln R_e/R_w)/(T\Delta p) \tag{13}$$

$\Delta p$ corresponds to the pressure drop between the top of the injection interval and the fluid in the deposit. When the water table is at ground level, the pressure drop is equal to the surface injection pressure. $R_e$ is the drainage radius, i.e., the distance from the injection well at which the fluid pressure is equal to the hydrostatic pressure at depth, L. The exact location of $R_e$ is ambiguous. In a pressure injection test, less than two hours are required to obtain steady-state conditions. In this period of time, the reservoir pressure will not change by more than 10% at distance 100 feet away from the injection hole. The value of $\ln (R_e/R_w)$ is approximately equal to six. Equation 13 becomes:

$$K = (28{,}600)\,(Q\mu/T\Delta p) \tag{14}$$

The viscosity of a fluid is a function of temperature. When the fluid is a liquid, the viscosity decreases as the temperature increases, thus the flow rate will increase at fixed pressure drop and permeability as the temperature increases. The converse is true of gas flow, because the viscosity of a gas increases with a rise in temperature. Table III lists values of the viscosity of water between 70° F. and 200° F.

Table III

Viscosity of Water as a Function of Temperature

| Temperature, ° F | Viscosity, centipoise |
|---|---|
| 70 | 1.00 |
| 100 | 0.75 |
| 140 | 0.50 |
| 200 | 0.30 |

An injectivity test performed in the bottom 70 feet of hole DDH-147 at Kennecott Copper Corporation's mine at Safford, Arizona gives the following results:

$Q = 15$ gpm
$T = 70$ feet
$\Delta p = 783$ psi
$\mu = 0.3$ centipoise

The permeability is computed from Equation (14).

$D = 28{,}600\ (15 \times 0.3/70 \times 783) = 2.4$ md

CONDITIONS SELECTED FOR BASE CASE

The base calculations assumed that fluid is injected over a 2,500 foot interval, with the top of the injection interval 2,500 feet below the surface. The maximum injection pressure is 1750 psi when the fracture gradient is taken as 0.7 psi per foot of depth. The maximum pressure drop between the injection and production wells in the five-spot pattern is 1750 psi when the injection well is drawn down to atmospheric pressure at the 2500 foot level. The flow rate is computed from Equation (12) for $d$ = 180 foot well spacing
$R_w$ = 0.25 feet
$K$ = 2.4 md
$\Delta p_T$ = 1750 psi
$T$ = 2500 feet
$\mu$ = 0.5 centipoise
$Q = (1.05\times10^{-4})\ (2.4\times2500\times1750/0.5)\ (1/5.96) =$ 370 gpm The flow rate per well computes to be 370 gallons per minute, which is equivalent to 532,000 gallons per day. The base case study used 400,000 gallons per day as a conservative estimate.

EXAMPLE I

Figure 8:
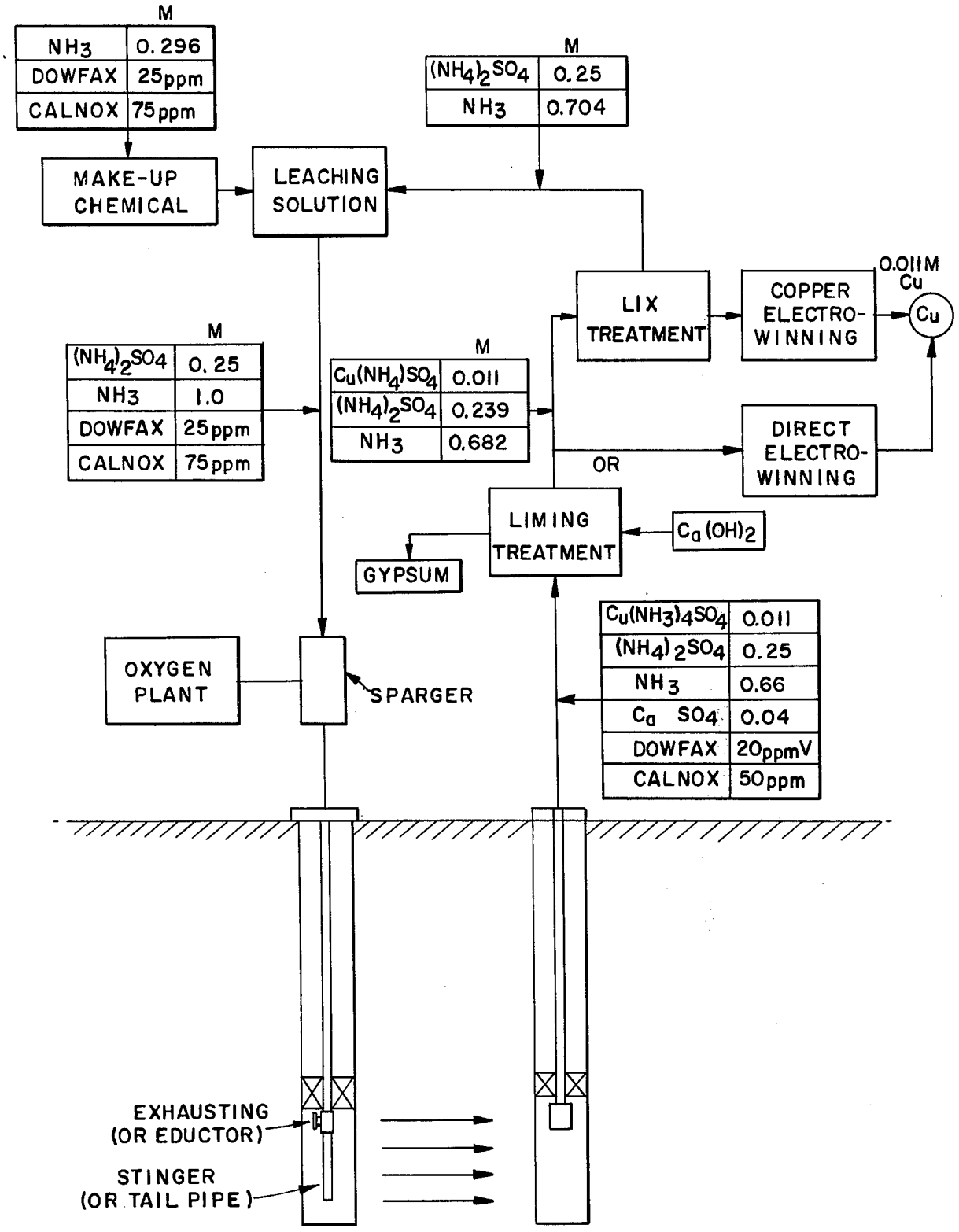

On May 29, 1975, an ammoniacal sulfate leaching test was carried out at the Kennecott Copper Corporation in-situ mine in Safford, Arizona. The injection hole was equipped in accordance with the procedure outlined above and shown in FIG. 1 of the drawing. The various material balances are shown in FIG. 8 of the drawing. The main copper mineral deposit was chalcopyrite. The average grade of copper was 0.45% and the porosity of the ore body was 3%.

At the start of the in-situ mining operation, the effluent copper concentration is diluted with the deposit water that is stored in the pores of the rock. It is expected that after a volume of lixiviant equal to the volume of deposit water stored in the rock between holes is pumped, i.e., one pore volume, the copper concentration will attain the design level. A similar dilution will be obtained at the end of the mining venture in order to recover the copper that is in solution in the pores of the rock.

When the reaction between oxidant and chalcopyrite is rapid, all of the oxidant is consumed in one pass of the fluid through the deposit. When the reaction is slow, oxidant remains in the lixiviant at the production hole and the effluent copper concentration will decrease.

The composition of the lixiviant was 1 M $NH_3$, 0.25M $(NH_4)_2SO_4$ with 25 ppmV Dowfax ®surfactant and 75 ppm Calnox ® additive. The solution was injected into a hole (ID: 149A) at a rate of 10 gallons per minute and mixed with 12 SCFM (standard cubic feet per minute) of gaseous oxygen. The packer was set at 3060 ft. and the two phase fluid was injected into the leaching interval with a tailpipe extended to 3160 feet. The downward fluid velocity in the 1 ½ inches pipe was 1.8 ft./sec.

The solution was recovered from a hole (ID:SA-2) which was located 70 ft. away from the injection hole. It was produced at 10 gallons per minute. On July 11, 1975, the produced solution had 0.71 g/1 of copper, 0.66 M $NH_3$, 0.04M $CaSO_4$.

A part of $(NH_4)_2SO_4$ was treated with lime to regenerate the ammonia and also to remove $CaSO_4$ in solution. After the pregnant liquor from the production hole was treated with lime, it was contacted with a liquid ion exchange extractant to extract the copper values. The extractant used was LIX-64N which is an oxime extractant sold by General Mills. At this point it should be noted that recovering the copper values from the pregnant solution is a step which is well known to those in the art and does not constitute a part of the invention. After the organic extractant is loaded with copper, it is stripped with a sulfuric acid ($H_2SO_4$). The stripped solution containing the copper values is then sent to an electrowinning circuit where the copper is electrowon.

EXAMPLE II

Details of a typical commercial process appear as follows. The ore body to be leached is a block lying between the levels 2500 feet and 5000 feet below the surface and having an aerial extent associated with 18 contiguous 5-spots, each having a producer to producer spacing of 330 feet. An example pattern is 18 5-spots contained within the area with dimensions 1650 feet by 1320 feet. The ore block is completely below the water table which lies 1000 feet below the surface.

The leaching process is initiated by pumping fluid from producer wells (28 in number), adding to that fluid: ammonia, sulfuric acid (to generate ammonium sulfate), an oxygen as a second phase; and pumping the fluid into injection wells in a continuous fashion. A concentration of 1.6M $NH_3$ and 0.4M $NH_4$ at the injection well is maintained. M indicates moles per liter.

Although the ultimate leaching interval is 2500 feet to 5000 feet, the initial interval exposed to leach solution contact is 3750 feet to 5000 feet ("half interval"). This is done to decrease the initial pore volume to be primed and thus speed breakthrough of copper, ammonia, and ammonium ion at producer wells. About 9600 tons of copper are produced in the first year of pumping with 88% of full production (40,000 TPY) being achieved in the second year of pumping. The rest of the interval is assumed to be opened up (by perforation of casing) in two stages occurring in pumping years 6–7 and years 14–15. Overall recovery as cathode copper over the life of the project is 45%.

Pregnant solution is pumped from producer wells by submersible pumps through a gas-liquid separator where gas entrainment occurs. The gas, which may contain some hydrogen, is diluted by an air blower before being vented. Total flow is 3450 gpm with a final copper concentration of 6 gpl.

Following gas separation, pregnant solution is pumped to the calcium treatment area of the main processing plant. Here, lime (in a crystallizer) is used to convert a portion of ammonium ion in the solution to ammonia. Under normal circumstances, ammonium ion builds up in the circuit due to chemical reactions associated with copper leaching and copper extraction. Lime treatment allows a savings in ammonia makeup. Calcium treatment also serves to control calcium supersaturation of pregnant solution.

As a result of the pressure of sulfate in the pregnant solution, gypsum is precipitated in the crystallizer. These solids are removed from the pregnant solution by a thickener followed by a rotary drum filter. Copper losses are kept to a minimum by washing the solids twice: first with a portion of raffinate from the liquid ion exchange section, and second, with water on the filter.

Copper is removed from solution by liquid ion exchange and electrowinning. Liquid ion exchange is operated with LIX-64N at 40° C. Aqueous feed solution must be cooled from about 70° to 40° C. prior to copper extraction. Activated carbon adsorbers are used to treat raffinate in order to remove most of any entrained or dissolved organic.

Makeup ammonia and two additives, Dowfax and Calnox®, are then added (by in-line mixer) to the leach solution. The purpose of Dowfax (25 ppm level) is to improve oxygen dispersion characteristics of the solution. The purpose of Calnox® (20 ppm level) is to inhibit scale formation on production well equipment. Calnox is removed by lime treatment in the gypsum crystallizer.

Leach solution, following reconstitution, is pumped back to the well field. An injection pump (up to 1200 psi pressure) pumps solution into a surface sparger where oxygen is dispersed. A guard filter precedes the injection pump to remove solids down to 20 ppm.

From the foregoing, one skilled in the art is taught how to remove base metals such as copper, nickel, molybdenum and mixtures thereof from igneous rocks located at a depth of 800 feet or more. The invention is particularly applicable to treating ore bodies that lie at a depth in feet and have a permeability in md that is twenty thousand md-ft or less. Prior to present invention there was no acceptable way of treating such ores in situ. The metal values are removed from the minerals in the minute fractures in the ore by forcing a two-phase lixiviant containing small oxygen bubbles into the fractures of the ore. To recover a metal, M, from a mineral in the ore having the general formula, $MFe_yS_x$, the minimum surface pressure, $P_{SM}$, of the two-phase lixiviant, in psi, is controlled at the surface in accordance with the following generalized formula:

$$P_{SM} \geqq \left(\frac{354.7\,[1.5x + 0.75y + 0.25z]}{MW}\right)\left(\frac{1 - f_{gc}}{f_{gc}}\right)(M/E), \text{ in psi}$$

where M is the metal loading in gpl of the ore metal value to be recovered, E is the overall efficiency of oxygen utilization, and MW is the molecular weight of the metal ion to be recovered, $z$ is the valance of the metal ion to be recovered in solution, and $y$ and $x$ are the subscripts for Fe and S, respectively, in the mineral.

It is also desirable to design the porosity of the sintered metal tubes so as to provide gas bubbles ($O_2$) which have diameters in the same order of magnitude or smaller than as the fracture openings in the ore. The diameters of the bubble therefore would be within the range of 2–1000 micron, but preferable, 10–100 microns.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A process for the in-situ mining of a metal value selected from the group consisting of copper, nickel, molybdenum and mixtures thereof from an underground igneous ore body located at a depth of 800 ft. or more, said ore body having a permeability such that the product of the ore body thickness in ft. and permeability in md is a value of 20,000 md-ft or less, said ore also having minute fractures in which the metal values to be recovered are located in chemical combination with sulfur in a mineral of the generel formula $MFe_yS_x$, said process comprising:

(a) drilling at least one injection hole and at least one production hole into said ore body;

(b) introducing a two-phase lixiviant down said injection hole and into a leaching interval in said ore body, said leaching interval being beneath the water table, said two-phase lixiviant being formed from (1) an aqueous leach liquor capable of solubilizing the metal values, and, (2) minute oxygen bubbles of a size small enough to enter the fractures in the ore body from which the metal values are to be recovered;

(c) forcing the two-phase lixiviant through the leaching interval of the underground ore body to enable the two-phase lixiviant to penetrate the ore body through the fractures in the ore body and to enable the oxygen bubbles in the two-phase lixiviant to react with the sulfur to which the metal values are chemically bonded to enable the metal values to be solubilized by the aqueous leach liquor to produce a pregnant solution of metal values, said two-phase lixiviant being forced through said leaching interval by controlling the surface pressure of the two-phase lixiviant so that the minimum surface pressure, $P_{SM}$, in psi, is in accordance with the equation $$P_{SM} \geqq \left(\frac{354.7\,[1.5x + 0.75y + 0.25z]}{MW}\right)\left(\frac{1-f_{gc}}{f_{gc}}\right)M/E, \text{ in psi}$$

where M is the metal loading in gpl of the metal value to be recovered, E is the overall efficiency of oxygen utilization, MW is the molecular weight of the metal ion to be recovered, $z$ is the valance of the metal ion to be recovered, $y$ and $x$ are the subscripts for Fe and S respectively in a mineral of the general formula $MFe_yS_x$, where M is the metal to be recovered, and $f_{gc}$ is the gas volume fraction associated with bubbly flow, the pressure of the two-phase lixiviant also being controlled so that the pressure of the two-phase lixiviant at the top of the leaching interval is less than the fracture pressure of the ore;

(d) withdrawing the pregnant solution to the surface through a production hole; and, (e) recovering metal values from the pregnant solution.

2. The process as set forth in claim 1, wherein the mineral is chalcopyrite and copper is leached from the chalcopyrite and wherein the minimum surface pressure $P_{SM}$, in psi is in accordance with the equation $$P_{SM} \geqq (23.7)\,(1\text{-}f_{gc}/f_{gc})\,(Cu/E)$$

where

Cu = copper loading, gpl

E = overall efficiency of oxygen utilization $f_{gc}$ = critical gas volume fraction associated with bubbly flow.

3. The process as set forth in claim 2 wherein $0.15 \leqq f_{gc} \leqq 0.25$.

4. The process as set forth in claim 3 wherein the igneous ore body has an average permeability of 10 md or less.

5. The process as set forth in claim 4 wherein the two-phase lixiviant is produced by forcing oxygen bubbles having a size between the range of 30 to 300 microns into the leach liquor.

6. The process as set forth in claim 5 wherein the surface pressure, $P_{SM}$, is greater than 800 psi.

7. The process as set forth in claim 6 wherein the pressure at the top of the leaching interval is 560 psi or more.

8. The process as set forth in claim 7 wherein the pressure at the top of the leaching interval is approximately 0.7–1.0 lbs. per sq.in. for each foot of depth from the surface to the top of the leaching interval.

9. The process as set forth in claim 4 wherein the surface pressure, $P_{SM}$, is greater than 800 psi.

10. The process as set forth in claim 9 wherein the pressure at the top of the leaching interval is 560 psi or more.

11. The process as set forth in claim 10 wherein the pressure at the top of the leaching interval is approximately 0.7–1.0 lbs. per sq.in. for each foot of depth from the surface to the top of the leaching interval.

12. The process as set forth in claim 3 wherein the surface pressure, $P_{SM}$, is greater than 800 psi.

13. The process as set forth in claim 12 wherein the pressure at the top of the leaching interval is 560 psi or more.

14. The process as set forth in claim 13 wherein the pressure at the top of the leaching interval is approximately 0.7–1.0 lbs. per sq.in. for each foot of depth from the surface to the top of the leaching interval.

15. The process as set forth in claim 2 wherein the igneous ore body has an average permeability of 10 md or less.

16. The process as set forth in claim 15 wherein the two-phase lixiviant is produced by forcing oxygen bubbles having a size between the range of 30 to 300 microns into the leach liquor.

17. The process as set forth in claim 16 wherein the surface pressure, $P_{SM}$, is greater than 800 psi.

18. The process as set forth in claim 17 wherein the pressure at the top of the leaching interval is 560 psi or more.

19. The process as set forth in claim 18 wherein the pressure at the top of the leaching interval is approximately 0.7–1.0 lbs. per sq.in. for each foot of depth from the surface to the top of the leaching interval.

20. The process as set forth in claim 15 wherein the surface pressure, $P_{SM}$, is greater than 800 psi.

21. The process as set forth in claim 20 wherein the pressure at the top of the leaching interval is 560 psi or more.

22. The process as set forth in claim 21 wherein the pressure at the top of the leaching interval is approximately 0.7–1.0 lbs. per sq. in. for each foot of depth from the surface to the top of the leaching interval.

23. The process as set forth in claim 2 wherein the surface pressure, $P_{SM}$, is greater than 800 psi.

24. The process as set forth in claim 23 wherein the pressure at the top of the leaching interval is 560 psi or more.

25. The process as set forth in claim 24 wherein the pressure at the top of the leaching interval is approximately 0.7–1.0 lbs. per sq.in. for each foot of depth from the surface to the top of the leaching interval.

26. The process as set forth in claim 1, wherein the mineral is pentlandite and nickel is leached from the pentlandite and wherein the minimum surface pressure, $P_{SM}$ in psi, is in accordance with the equation $$P_{SM} \geqq (39.2)\,(1-f_{gc}/f_{gc})\,(\mathrm{Ni/E})$$

where,

Ni = nickel loading, gpl

E = overall efficiency of oxygen utilization $f_{gc}$ = critical gas volume fraction associated with bubbly flow.

27. The process as set forth in claim 26 wherein the igneous ore body has an average permeability of 10 md or less.

28. The process as set forth in claim 27 wherein the two-phase lixiviant is produced by forcing oxygen bubbles having a size between the range of 30 to 300 microns into the leach liquor.

29. The process as set forth in claim 28 wherein the surface pressure, $P_{SM}$, is greater than 800 psi.

30. The process as set forth in claim 29 wherein the pressure at the top of the leaching interval is 560 psi or more.

31. The process as set forth in claim 30 wherein the pressure at the top of the leaching interval is approximately 0.7–1.0 lbs. per sq.in. for each foot of depth from the surface to the top of the leaching interval.

32. The process as set forth in claim 31 wherein the surface pressure, $P_{SM}$, is greater than 800 psi.

33. The process as set forth in claim 32 wherein the pressure at the top of the leaching interval is 560 psi or more.

34. The process as set forth in claim 33 wherein the pressure at the top of the leaching interval is approximately 0.7–1.0 lbs. per sq. in. for each foot of depth from the surface to the top of the leaching interval.

35. The process as set forth in claim 26 wherein the surface pressure, $P_{SM}$, is greater than 800 psi.

36. The process as set forth in claim 35 wherein the pressure at the top of the leaching interval is 560 psi or more.

37. The process as set forth in claim 36 wherein the pressure at the top of the leaching interval is approximately 0.7–1.0 lbs. per sq. in. for each foot of depth from the surface to the top of the leaching interval.

38. The process as set forth in claim 26 wherein $0.15 \leqq f_{gc} \leqq 0.25$.

39. The process as set forth in claim 1 wherein the mineral is molybdenite and molybdenum is recovered from the ore and wherein the minimum surface pressure, $P_{SM}$ in psi, is in accordance with the equation $$P_{SM} \geqq (16.6)\,(1-f_{gc}/f_{gc})\,(\mathrm{Mo/E})$$

Mo = molybdenum loading, gpl

E = overall efficiency of oxygen utilization $f_{gc}$ = critical gas volume fraction associated with bubbly flow.

40. The process as set forth in claim 39 wherein the igneous ore body has an average permeability of 10 md or less.

41. The process as set forth in claim 40 wherein the two-phase lixiviant is produced by forcing oxygen bubbles having a size between the range of 30 to 300 microns into the leach liquor.

42. The process as set forth in claim 41 wherein the surface pressure, $P_{SM}$, is greater than 800 psi.

43. The process as set forth in claim 42 wherein the pressure at the top of the leaching interval is 560 psi or more.

44. The process as set forth in claim 43 wherein the pressure at the top of the leaching interval is approximately 0.7–1.0 lbs. per sq. in. for each foot of depth from the surface to the top of the leaching interval.

45. The process as set forth in claim 40 wherein the surface pressure, $P_{SM}$, is greater than 800 psi.

46. The process as set forth in claim 45 wherein the pressure at the top of the leaching interval is 560 psi or more.

47. The process as set forth in claim 46 wherein the pressure at the top of the leaching interval is approximately 0.7–1.0 lbs. per sq. in. for each foot of depth from the surface to the top of the leaching interval.

48. The process as set forth in claim 39 wherein the surface pressure, $P_{SM}$, is greater than 800 psi.

49. The process as set forth in claim 48 wherein the pressure at the top of the leaching interval is 560 psi or more.

50. The process as set forth in claim 49 wherein the pressure at the top of the leaching interval is approximately 0.7–1.0 lbs. per sq. in. for each foot of depth from the surface to the top of the leaching interval.

51. The process as set forth in claim 39 wherein $0.15 \leqq f_{gc} \leqq 0.25$.

52. The process as set forth in claim 1 wherein the igneous ore body has an average permeability of 10 md or less.

53. The process as set forth in claim 52 wherein the two-phase lixiviant is produced by forcing oxygen bubbles having a size between the range of 30 to 300 microns into the leach liquor.

54. The process as set forth in claim 53 wherein the surface pressure, $P_{SM}$, is greater than 800 psi.

55. The process as set forth in claim 54 wherein the pressure at the top of the leaching interval is 560 psi or more.

56. The process as set forth in claim 55 wherein the pressure at the top of the leaching interval is approximately 0.7–1.0 lbs. per sq. in. for each foot of depth from the surface to the top of the leaching interval.

57. The process as set forth in claim 52 wherein the surface pressure, $P_{SM}$, is greater than 800 psi.

58. The process as set forth in claim 57 wherein the pressure at the top of the leaching interval is 560 psi or more.

59. The process as set forth in claim 58 wherein the pressure at the top of the leaching interval is approximately 0.7–1.0 lbs. per sq. in. for each foot of depth from the surface to the top of the leaching interval.

60. The process as set forth in claim 1 wherein the solution produced after values are recovered from the pregnant solution is returned back to an injection hole to be used as the liquid phase of the two-phase lixiviant.

61. The process as set forth in claim 60 wherein the surface pressure, $P_{SM}$, is greater than 800 psi.

62. The process as set forth in claim 61 wherein the pressure at the top of the leaching interval is 560 psi or more.

63. The process as set forth in claim 62 wherein the pressure at the top of the leaching interval is approximately 0.7–1.0 lbs. per sq. in. for each foot of depth from the surface to the top of the leaching interval.

64. The process as set forth in claim 1 wherein the ore body is a porphyry copper ore in which copper bearing sulfide minerals occur in desseminated grains or veinlets.

65. The process as set forth in claim 64 wherein the copper bearing mineral is chalcopyrite.

66. The process as set forth in claim 65 wherein the surface pressure, $P_{SM}$, is greater than 800 psi.

67. The process as set forth in claim 66 wherein the pressure at the top of the leaching interval is 560 psi or more.

68. The process as set forth in claim 67 wherein the pressure at the top of the leaching interval is approximately 0.7–1.0 lbs. per sq. in. for each foot of depth from the surface to the top of the leaching interval.

69. The process as set forth in claim 64 wherein the surface pressure, $P_{SM}$, is greater than 800 psi.

70. The process as set forth in claim 69 wherein the pressure at the top of the leaching interval is 560 psi or more.

71. The process as set forth in claim 70 wherein the pressure at the top of the leaching interval is approximately 0.7–1.0 lbs. per sq. in. for each foot of depth from the surface to the top of the leaching interval.

72. The process as set forth in claim 1 wherein the two-phase lixiviant is produced by forcing oxygen bubbles having a size between the range of 30 to 300 microns into the leach liquor.

73. The process as set forth in claim 72 wherein the surface pressure, $P_{SM}$, is greater than 800 psi.

74. The process as set forth in claim 73 wherein the pressure at the top of the leaching interval is 560 psi or more.

75. The process as set forth in claim 74 wherein the pressure at the top of the leaching interval is approximately 0.7–1.0 lbs. per sq. in. for each foot of depth from the surface to the top of the leaching interval.

76. The process as set forth in claim 1 wherein the surface pressure, $P_{SM}$, is greater than 800 psi.

77. The process as set forth in claim 76 wherein the pressure at the top of the leaching interval is 560 psi or more.

78. The process as set forth in claim 77 wherein the pressure at the top of the leaching interval is approximately 0.7–1.0 lbs. per sq. in. for each foot of depth from the surface to the top of the leaching interval.

79. The process as set forth in claim 1 wherein the pressure of the two-phase lixiviant at the top of the leaching interval is lowered from the surface pressure if the pressure of the lixiviant at the top of the leaching interval would exceed the fracture pressure of the ore.

80. The process as set forth in claim 79 wherein the pressure at the top of the leaching interval is lowered by the use of a choke.

81. The process as set forth in claim 1 wherein the aqueous leach liquor of step (b) (1) is an acidic leach liquor.

82. The process as set forth in claim 1 wherein the aqueous leach liquor of step (b) (1) is an ammoniacal leach liquor.

83. A process for the in-situ mining of a metal value selected from the group consisting of copper, nickel, molybdenum and mixtures thereof from an underground igneous ore body located beneath the water table comprising the following steps:

(a) selecting an ore body located at a depth of 800 feet or more below the surface and having a permeability of 10 md or less and having minute fractures 30–300 microns wide in which the metal values to be recovered are located in a mineral which contains sulfur;

(b) drilling at least one injection hole and at least one production hole into said ore body;

(c) introducing a two-phase lixiviant down said injection hole and into a leaching interval in said ore body, said leaching interval being beneath the water table, said two-phase lixiviant being formed from -

(1) an aqueous leach liquor capable of solubilizing the metal values, and, (2) minute oxygen bubbles of a size small enough to enter the fractures in the ore body from which the metal values are to be recovered;

(d) forcing the two-phase lixiviant through the leaching interval of the underground ore body at a pressure greater than 800 lbs. per square inch but less than the fracture pressure of the ore to enable the oxygen bubbles in the two-phase lixiviant to react with the sulfur to which the metal values are chemically bonded to enable the metal values to be solubilized by the aqueous leach liquor to produce a pregnant solution of metal values;

(e) withdrawing the pregnant solution to the surface through one or more production holes; and, (f) recovering metal values from the pregnant solution.

84. An apparatus for enabling metal values to be leached below the surface comprising:

(a) an injection hole for introducing a leach liquor into the mineral to be leached;

(b) a first means for introducing bubbles of an oxidizing gas having diameters within the range of 2–1,000 microns into said leach liquor to produce a two-phase lixiviant in which one phase is minute bubbles of an oxidizing gas which bubbles have diameters within the range of 2–1,000 microns; and, (c) a second means for enabling continuous vertical circulation of the two-phase lixiviant within the leaching interval of said injection hole comprising a suction device with an outlet located in a lower portion of the leaching interval and an aspirator passage inlet located in the upper portion of the leaching interval, said first and second means together enabling continuous circulation of the two-phase lixiviant and also reducing coalescence of the bubbles of oxidizing gas.

85. Apparatus for the in-situ mining of minerals comprising:

(a) a gas sparging unit for use in introducing finely divided gas bubbles into a lixiviant used for in-situ mining of minerals, said device comprising a hollow casing having a first chamber formed therein into which liquid lixiviant is supplied and a second chamber isolated from said first chamber; a plurality of porous tubes formed of sintered powdered metal extending into said second chamber with said tubes having one end in fluid communication with said first chamber; and, means for introducing a pressurized gas about the portion of said tubes in said second chamber to enable the gas to penetrate into said tubes so that the gas can be wiped from the interior of the tubes by the lixiviant flowing through the tubes to form a lixiviant containing finely divided bubbles; and, (b) a venturi-type exhauster in fluid communication with the sparging unit.

86. The apparatus as set forth in claim 85 wherein said exhauster has a tailpipe forming an outlet and an aspirator.

87. The apparatus as set forth in claim 86 wherein the exhauster and tailpipe prevent coalescence of the oxygen bubbles by enabling continuous vertical circulation of the lixiviant between the outlet of the injection nozzle and the aspirator passage inlet.

88. The apparatus as set forth in claim 87 wherein said casing has an outlet end with said first chamber being isolated from said outlet end and with the down stream ends of said tubes being positioned so that lixiviant containing gas bubbles can pass through said outlet end.

89. The apparatus as set forth in claim 85 wherein said means for introducing pressurized gas to said chamber comprises an inlet opening into said second chamber.

90. The apparatus as set forth in claim 89 wherein said inlet opening is formed through said casing.

91. The apparatus as set forth in claim 89 wherein said inlet opening is formed in a partition isolating said first and second chambers and wherein a gas supply tube positioned within said first chamber delivers pressurized gas through said inlet opening into said second chamber.

92. The apparatus as set forth in claim 88 wherein said gas supply tube, said first chamber and said second chamber are located in axial alignment to enable said unit to be inserted down a well bore.

93. The apparatus as set forth in claim 88 including means for removing gas bubbles trapped upstream of said outlet, said means comprising a conduit for providing communication between the interior of said casing adjacent the outlet end and the exterior of said casing.

94. The apparatus as set forth in claim 93 wherein said casing comprises a generally vertically extending cylindrical sleeve with said first chamber and second chamber being located in axial alignment in said sleeve and with said conduit extending axially within said sleeve through said first and second chambers.

95. The apparatus as set forth in claim 94 including a generally funnel shaped guide surface adjacent the outlet for guiding bubbles into the conduit.

96. The apparatus as set forth in claim 82 wherein said venturi type exhauster is positioned in the leaching interval of an in-situ injection hole beneath a cemented and packed off position of the injection hole.

97. A method for recovering metal values in-situ comprising:

(a) drilling at least one injection hole and at least one production hole into an ore body;

(b) introducing a two-phase lixiviant down said injection hole into a leaching interval in said ore body, said two-phase lixiviant being made by supplying a leach liquor into a porous tube of sintered metal while an oxidizing gas is supplied under pressure around the tube, said pressure being sufficient to cause the oxidizing gas to penetrate into the interior of the tubes as fine bubbles which are wiped off by the leach liquor passing therethrough; and, (c) injecting the two-phase lixiviant into the leaching interval of the ore body through an aspirator which reduces coalescence of the bubbles of oxidizing gas by maintaining continuous vertical circulation within the leaching interval.

98. The process as set forth in claim 97 wherein the porosity of the sintered metal tubes are controlled so as to provide bubbles of oxidizing gas which are of the same order of magnitude or smaller than the fracture openings in the ore.

* * * * *